US005810509A

United States Patent [19]

Nahlik, Jr.

[11] Patent Number: 5,810,509

[45] Date of Patent: Sep. 22, 1998

[54] BURIED FIELD DRAINAGE PIPE

[76] Inventor: Joe Nahlik, Jr., 23018-Hwy. 49, Saucier, Miss. 39574

[21] Appl. No.: 858,535

[22] Filed: May 19, 1997

Related U.S. Application Data

[63] Continuation of Ser. No. 598,072, Feb. 7, 1996, abandoned, which is a continuation of Ser. No. 178,967, Jan. 7, 1994, abandoned.

[51] Int. Cl.[6] ..... E02B 11/00

[52] U.S. Cl. ..... 405/43; 405/45

[58] Field of Search ..... 405/36, 43, 45, 405/48, 50

[56] References Cited

U.S. PATENT DOCUMENTS

| | | | |
|---|---|---|---|
| 299,347 | 5/1884 | Chisholm | 405/48 |
| 2,817,956 | 12/1957 | Young | 405/45 |
| 3,946,762 | 3/1976 | Green | 405/45 |
| 4,909,665 | 3/1990 | Caouette | 405/45 |
| 5,051,028 | 9/1991 | Houck et al. | 405/45 |

FOREIGN PATENT DOCUMENTS

| | | | |
|---|---|---|---|
| 1210158 | 10/1970 | United Kingdom | 405/45 |
| 2005972 | 5/1979 | United Kingdom | 405/45 |
| 8101580 | 6/1981 | WIPO | 405/48 |

*Primary Examiner*—Tamara L. Graysay
*Assistant Examiner*—Frederick L. Lagman
*Attorney, Agent, or Firm*—Pravel, Hewitt & Kimball

[57] ABSTRACT

A drain piping for forming buried drainage fields is formed from a flexible plastic pipe having periodically spaced restricted water flow orifices. Around the flexible pipe at each orifice is placed a larger diameter section of highly perforated drain pipe forming a drain cell; the cell is wrapped with a porous plastic cloth wrap (e.g. GeoTextile™—a known membrane cloth for preventing dirt migration). This pipe can be directly buried in dirt filled trenches; no special drainage provisions, such as crushed stone are required. Each cell individually fills with and drains waste water and sludge. The inventive pipe can be laid in uneven terrain, including areas win which the water table may rise above the level of some sections of pipe. Even if drainage is temporarily blocked form one cell, the pipe will properly drain through the other cells.

2 Claims, 2 Drawing Sheets

BURIED FIELD DRAINAGE PIPE

This is a continuation of application Ser. No. 08/178,967 filed on Jan. 7, 1994, now abandoned which is a continuation of application Ser. No. 08/598,072 filed on Feb. 7, 1996, now abandoned.

BACKGROUND OF THE INVENTION

This Invention pertains to the field of soil irrigation and drainage field systems, piping, plumbing and components.

U.S. Pat. No. 2,653,449 to Stauch shows a soil irrigation system comprising a plurality of end to end connected pipes buried beneath the soil in varying depth terrain. Each of the pipes has an almost completely sealed surface, having an area of restricted permeability, to restrict water flow into the soil so as to insure uniform flow of water throughout the length of the pipe.

U.S. Pat. No. 4,950,103 to Justice discloses a corrugated drainage tube of a type suitable for making an irrigation field, the tube having annular peaks and valleys on the exterior wall and periodic holes in the wall of the tube for drainage.

U.S. Pat. No. 2,817,956 to Young discloses a soil moisture controlled irrigation system in which a drainage field is constructed of an array of end connected piping; periodically located along the piping are larger permeable tubes forming an open annular space for filling with water.

U.S. Pat. No. 3,936,380 to Boske discloses a drainage or irrigation pipe surrounded by a fibrous material to prevent clogging of the holes in the pipe.

U.S. Pat. No. 5,051,028 discloses a drainage unit formed by bagging a loose aggregate around the exterior of the drainage pipe as a replacement for burying aggregate in a trench and burying a pipe in the trench.

U.S. Pat. No. 4,904,112 to McDonald discloses an underground irrigation system in which two concentric tubes, an inner water pipe with periodically spaced drain holes, and an outer permeable pipe surrounding are installed in a field for drainage.

U.S. Pat. No. 3,220,194 to Lienard discloses a drainage system including a series of compartments each filled with an absorbent sponge-like material to control the flow of liquid into the field.

U.S. Pat. No. 3,946,762 to Green discloses an underground irrigation system comprising an end to end connected series of drainage pipes with periodically spaced apertures surrounded by a cloth material or fabric sheet to prevent incursion of soil and salts into the drainage pipe. Specific fabrics are disclosed as suitable for this purpose.

SUMMARY OF THE INVENTION

The Invention relates to the construction of draining piping for forming buried drainage fields.

Prior art drain pipe is either porous or open bottomed clay pipe or plastic pipe with repeated drain holes. Such pipe must be laid in a prepared drain field in which an open trench, which must be larger than the pipe, is backfilled with crushed stone and the pipe laid in the stone to form a drainage field. The principle problem to avoid is dirt entering and clogging the pipe drain holes, and equally, sludge clogging the drain holes because free drainage flow from the pipe is impeded.

The invention is a flexible plastic pipe having periodically spaced restricted flow orifices. Around each flow orifice is placed a larger diameter section of highly perforated or permeable drain pipe to form a drain cell; the cell is wrapped with a porous plastic cloth wrap (e.g. GeoTextile™—a known membrane cloth for preventing dirt migration).

This pipe can be directly buried in dirt filled trenches; no special drainage provisions, such as crushed stone are required. More importantly each cell individually fills with and drains waste water and sludge, The inventive pipe can be laid in uneven terrain, including areas win which the water table may rise above the level of some sections of pipe. Even if drainage is temporarily blocked from one cell, the pipe will properly drain through the other cells.

The drain field of the invention is described in terms of a disposal field for liquid effluent or treated waste water. It also can be used for small field irrigation.

Since plastic pipe, the usual material from which the invention is constructed, is undetectable, it may be desirable as an option to install a wire along the pipe, which can be detected by standard buried wire detection equipment.

It is an object of the invention to disclose a drainage pipe which is insensitive to the local slope and terrain of the ground within which it is buried.

It is a further object of the invention to disclose a drainage pipe which provides for uniform distribution of water in a drainage field without requiring terracing or extensive ground preparation to insure soil slope or permeability.

It is a further object of the invention to disclose a drainage pipe which is relatively insensitive to local soil saturation or depth, in maintaining a uniform distribution of water to the entire drainage field.

It is a further object of the invention to disclose a drainage pipe which maintains a uniform water distribution to a drainage field, and is relatively unaffected by varying soil conditions or terrain within the field.

DETAILED DESCRIPTION OF THE INVENTION

This Invention deals with irrigation or drain fields and the associated plumbing, piping and equipment necessary for irrigation, waste water disposal, or for drainage into a large ground area, of water or of liquid effluent from water treatment, plants or water treatment systems.

Figure 1:
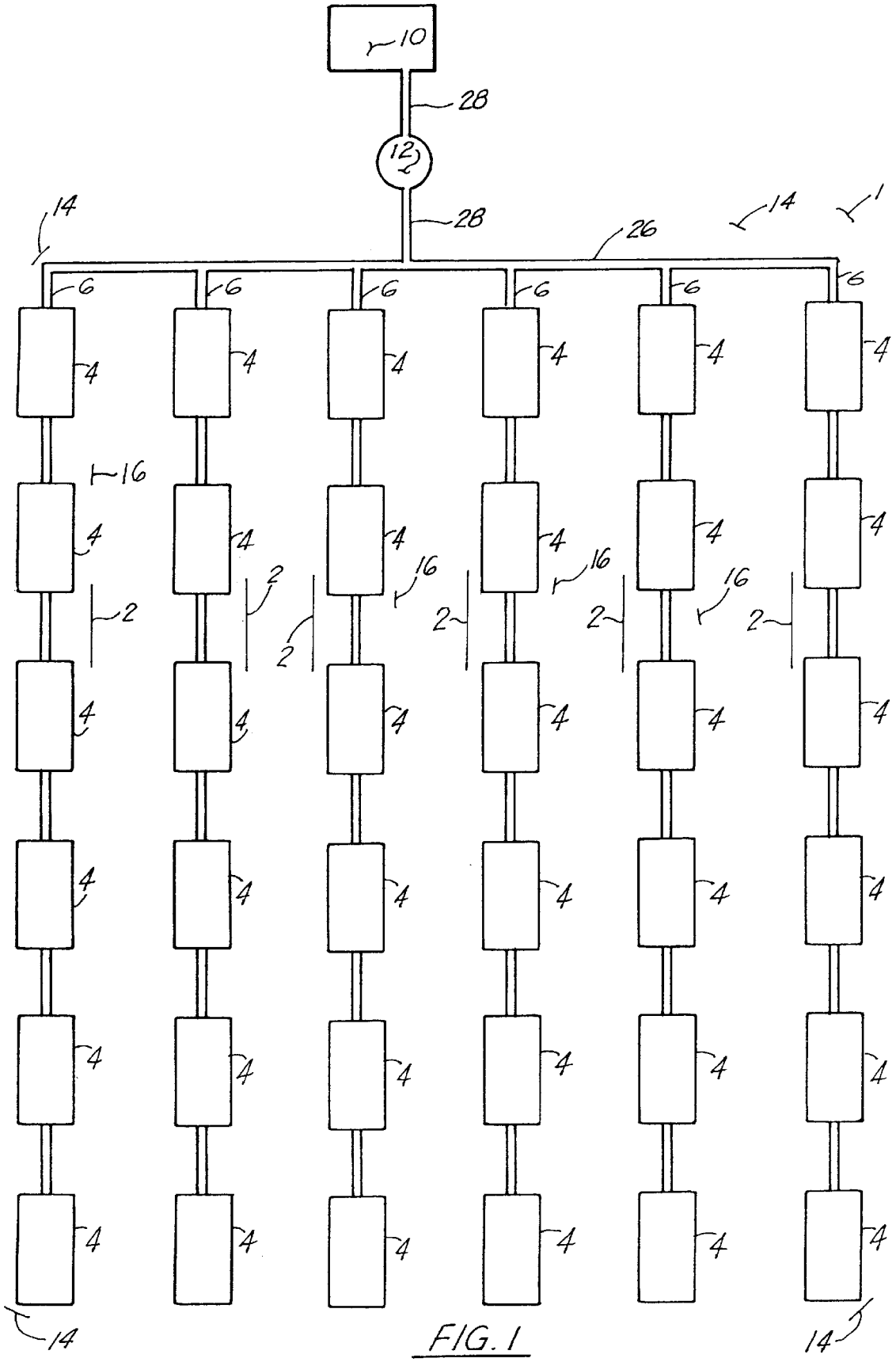
FIG. 1 is a depiction of a buried drainage field.

Referring to the general outline figure, FIG. 1, a typical irrigation or waste water disposal system (1) will consist of a treatment plant (10) which, through various biologically active processes, neutralizes and treats waste water, separating the waste water into a treated liquid effluent and a solid which will be received and held within the treatment plant for separate disposal. The treated effluent from the treatment plant normally is then drained off into a holding tank (12) and is pumped into a drain field (14). In the prior art a drain field generally consists of various forms of long drainage pipes (2), perforated or otherwise permeable to water, which are laid out underground over a large ground area so that the water will soak gradually into the ground (16) and be recycled into ground water. Similar systems are used for irrigation of crops.

Since water follows well-known hydrostatic principles, pooling in low spots, and since perforated drain pipes (2)

only drain water when there is a differential hydrostatic pressure across the pipe, the outside soil must be drier than the pipe in order for water to percolate into the soil. It is normally necessary to prepare the drain field by tillage, trenching and the like, to establish a preferred slope for even flow of the water through each of the drain pipes, and, additionally, to ensure that the drain pipes are above the water table under all conditions, so that the drain pipes will evenly drain. Failure to do this results in a completely uneven distribution of water flow throughout the drain field and a much less effective disposal of water as large areas of the drain field may be rendered non-functional due to lack of flow of water or due to pooling of the water within lower sections of the field.

Figure 2:
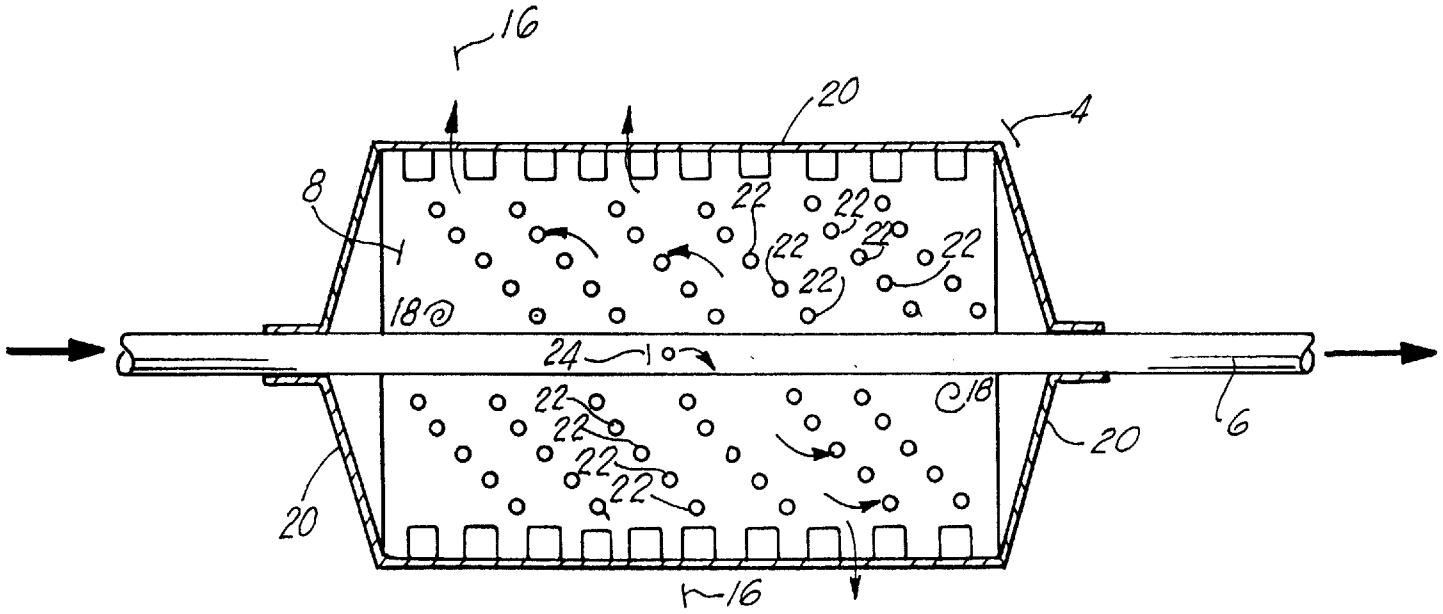
FIG. 2 is a sectional view of a drainage cell of the invention.

The Invention overcomes these problems by providing a unique form of pressure cell drain pipe (2) using repeatedly occurring pressure drainage cells (4) interconnected by drain pipe as more particularly shown in FIG. 2.

Within FIG. 2, we show a specific pressure cell (4) installed around the outer periphery of a length of flexible water pipe (6), typically one-half inch diameter or larger. This water pipe is interconnected in an array (14) and forms a distribution field for pumping water or a drainage effluent to each of the pressure cells (4). Along each length of water pipe (6) a plurality of series of pressure cells (4) is periodically installed at various spacings which depend upon the nature, porosity and dryness of the surrounding soil.

Each pressure cell (4) consists of a length of outer perforated drain pipe (8) circumferentially spaced around the water pipe (6) so as to form an open enclosed space (18) around a length of the flexible water pipe (6) which is free from dirt or soil. The perforated drain pipe (8) may be secured to the water pipe (6) by a filter wrap (20). The filter wrap (20) preferably is a fabric wrap, such as a geotextile which prevents soil particles and dirt from contacting or filling the perforations within the perforated drain pipe (8). Various fabric or woven plastic wraps are known to be suitable for such use.

The outer drain pipe (8) has sufficient perforations or is sufficiently permeable that it rapidly drains into dry soil (16). In the open interior annular space (18) defined by positioning the perforated drain pipe (8) around the flexible water pipe (6), a restricted water passage hole (24) connects for water flow from the water pipe into the annular space (18). This hole (24) is designed specifically so that the maximum flow rate of effluent water, under pressure in the water pipe (6), through the hole (24) and into the open annular space (18) is significantly less than the flow rate of water out of the drain pipe (8) into soil (16). Additionally, the flow rate through all individual hole (24) under the total range of pressures from highest possible to lowest general pressure of water in the water pipe (6) is significantly less than the unrestricted flow rate of water through the flexible water pipe (6).

As an example, in one particular embodiment of the Invention, using one-half inch flexible water pipe (6) interconnecting in a field (14) using cells (4) spaced at approximately two foot lengths along the water pipe (6), the cell (4) would be created in each case by a four inch diameter perforated drain pipe (8) forming the annular space (18) of one and three quarters inch radial cross section, each perforated drain pipe (8) being three feet long, and the drain hole (24) into the annular space (18) is a single three-sixteenths inch diameter drain hole (24).

As a result of the flow restriction imposed by drain hole (24) into the large open annular drain space (18) created in the pressure cell (4) which is free of soil but free to be filled with water. The resulting drain field (14) may be laid without regard to the relative height or depth of any particular pressure cell (4) and without regard to the presence or absence of the water table or saturated soil at lower elevations, which may fill one or more of the individual pressure cells with water. Thus, the drain field (14) may be laid over irregular terrain simply by trenching and burying the drain field (14) a shallow distance under the level of the ground. Typically, if the drainage field is made of a plurality of one-half inch diameter flexible water pipes (6), each water pipe (6) will be connected at a head end to a header line (26), which may be one and one-half inches in diameter. The header line (26) is connected to a supply line (18) from the holding tank (12) and pump for effluent or irrigation water source, and the far end of each one-half inch flexible water pipe (6) line is capped and closed. The fact that an individual pressure cell (4) may be higher or lower than the adjacent pressure cell (4) and that the entire drain line (2) may follow an undulating or irregular height does not cause puddling of the water, because the individual drain holes (24) into each pressure cell (4) are sufficiently smaller than the typical percolation rate from the cell (4) and are also sufficiently smaller in terms of the total flow rate of water through the water pipe (6) that there is no preferential puddling or pooling of water in an individual pressure cell (4) due to the height or depth of the pressure cell (4) with respect to the average height or depth of the rest of the drain field (14). As a result, each pressure cell (4) will receive a uniform supply of water, and each area of the drainage field (14) will, therefore, be uniformly wet.

It may be that during saturated soil conditions, one or more of the pressure cells (4) will actually fill with water. The result in this case will simply be that no water will flow through the pressure hole (24) from the water pipe (6) into that particular pressure cell (4). None the less, the back pressure on the hole (24) will have negligible effect on the overall behavior of the rest of the drain field (14) and all the individual pressure cells (4) not fully saturated with water will continue to flow at the design rate determined by the water pressure head within the flexible water pipe (6) and the diameter of the single feed hole (24) into each individual pressure cell (4).

As a result, a drain field (14) utilizing sequential series of pipes (6) and pressure cells (4) of the Invention may be laid without requiring extensive preparation, leveling or other extensive trenching operations to prepare trenches for even flow of water. Further, the drain field (14) may be laid without significant concern for the possibility of occasional flooding of low-lying areas or water saturation of low-lying areas in the drain field (14). It is, thus, possible to lay a drain field (14) directly in soil (16), without requiring gravel beds or other preparation; the drain field (14) can follow the natural slope of the terrain (16) without concern for the relative individual height or depth below water head of each individual pressure cell (4). Each drain cell (4) forms a large water absorbing volume, relatively speaking, with respect to the water flow rate of a single drain hole (24) from the water supply pipe (6) into the pressure cell (4). As a result, the back pressure, if any, on any particular drain cell (4) will not adversely effect the flow rate of water throughout the entire drain field (14), and each drain cell (4) is, therefore, decoupled essentially from the performance of the rest of the drain line (2). Individual cells (4), therefore, provide optimal drainage of water into the local soil (16) within which they are buried. They do not adversely effect or provide back pressure against the flow of water to other individual pressure cells (4) and, therefore, the drainage field (14) stabilizes at an optimum overall absorption of water into the ground (16), each individual pressure cell (4) providing optimum seepage of water into its local environment without adversely effecting the flow or capturing the flow of water from the remainder of the field (14).

It can, thus, be seen that, in addition to significantly reducing the cost of preparation of a drain field (14) for receiving the inventive array of pressure cells (4) connected by pipes (6), the Invention provides an additional advantage in that it provides a more uniform distribution of water throughout the drain field (14), minimizing puddling and saturation in local areas of the drain field (14) which may be lower or more absorptive than other areas. Further, a drain field (14) having varied soil types, having different percolation rates for water, will not result in saturation by water in the low percolation areas, nor will it divert water to the high percolation areas, but, rather, will ensure a uniform distribution of water throughout the field (14) independently of the soil percolation rates or absorptions in any localized area of the drain field (14).

A particular size has been shown as an example to guide the user, but it must be understood the Invention extends to all combinations of drain fields in which water supply pipes (6) have periodically positioned pressure cells, each pressure cell being connected to the water supply pipe by a restricted orifice (24) or opening which isolates water flow restrictions and flow properties of a particular pressure cell (4) from the overall flowrate of water in the drain pipes (6).

The Invention, therefore, extends to those broader equivalents inherent in the Claims.

I claim:

1. A drainage tube for burial in soil comprising:

a length of liquid supply pipe;

a plurality of periodically spaced permeable drain pipe sections spaced around said supply pipe, each forming an open water receiving space;

a restricted flow orifice from said supply pipe into each drain pipe section for supplying liquid into said space, the flow orifice in the supply pipe being of a restricted diameter, so that as liquid in the supply pipe is supplied to each drain pipe, the liquid would continue to flow to subsequent pipe drain sections along the supply pipe, to supply each of the pipe drain sections with liquid from the flow orifice of the supply pipe;

a plurality of flow bores in the wall of each of said drain pipe sections for allowing water to flow from each of the drain pipe sections into the surrounding soil around said drainage tube; and a fabric filter wrap formed around a portion of the drain pipe for securing the drain pipe around the supply pipe and for preventing soil particles and dirt from contacting or filling the perforations within the drain pipe.

2. A fluid distribution cell for use on a buried drain pipe in a drain field for draining waste water, the cell comprising:

a) a tubular permeable section surrounding a length of supply pipe, the permeable section spaced apart from said supply pipe and forming an open annular space around said supply pipe;

b) the tubular permeable section further comprising a fabric filter wrap for securing the tubular permeable section around the supply pipe and for preventing soil particles and dirt from contacting or filling the perforations within the tubular permeable section;

c) a flow bore in said supply pipe, for restricting water flow from said supply pipe into said open annular space, such that said waste water flow through said flow bore is decoupled from waste water flow through said permeable section;

d) a plurality of flow bores in the wall of said fluid distribution cell for allowing waste water to flow through the bores in the wall of the fluid distribution cell into the surrounding soil around said fluid distribution cell.

* * * * *